US006682183B2

(12) United States Patent
Jones et al.

(10) Patent No.: US 6,682,183 B2
(45) Date of Patent: Jan. 27, 2004

(54) SEAL MEMBER FOR INK JET CARTRIDGE

(75) Inventors: Bruce S. Jones, Franklin, TN (US); Stephen A. Anderson, Thompson Station, TN (US)

(73) Assignee: Nu-Kote International, Inc., Dallas, TX (US)

( * ) Notice: Subject to any disclaimer, the term of this patent is extended or adjusted under 35 U.S.C. 154(b) by 0 days.

(21) Appl. No.: 10/170,483

(22) Filed: Jun. 13, 2002

(65) Prior Publication Data

US 2002/0191059 A1 Dec. 19, 2002

Related U.S. Application Data

(60) Provisional application No. 60/298,039, filed on Jun. 13, 2001.

(51) Int. Cl.[7] ..... B41J 2/175
(52) U.S. Cl. ..... 347/85; 347/86
(58) Field of Search ..... 347/85–87

(56) References Cited

U.S. PATENT DOCUMENTS

| | | | | |
|---|---|---|---|---|
| 3,967,286 A | | 6/1976 | Andersson et al. | 347/87 |
| 4,005,440 A | | 1/1977 | Amberntsson et al. | 347/68 |
| 4,015,271 A | | 3/1977 | Sultan | 347/44 |
| 4,095,237 A | | 6/1978 | Amberntsson et al. | 347/87 |
| 4,279,519 A | | 7/1981 | Shiurila | 400/124.1 |
| 4,336,767 A | | 6/1982 | Wada | 118/264 |
| 4,400,102 A | | 8/1983 | Shiurila et al. | 400/124.1 |
| 4,403,874 A | | 9/1983 | Payne et al. | 400/124.09 |
| 4,579,468 A | | 4/1986 | Gomi et al. | 400/124.1 |
| 4,771,298 A | | 9/1988 | Lee et al. | 347/68 |
| 5,025,271 A | | 6/1991 | Baker et al. | 347/87 |
| 5,084,713 A | | 1/1992 | Wong | 347/87 |
| 5,156,471 A | | 10/1992 | Suzuki et al. | 400/124.1 |
| 5,174,665 A | | 12/1992 | Suzuki et al. | 400/124.1 |
| 5,189,443 A | * | 2/1993 | Arashima et al. | 347/86 |
| D351,190 S | | 10/1994 | Oshima et al. | 347/86 |
| 5,363,130 A | | 11/1994 | Cowger et al. | 347/92 |
| 5,444,474 A | | 8/1995 | Ohtsubo et al. | 347/87 |
| 5,477,963 A | | 12/1995 | Mochizuki et al. | 347/86 |
| D369,383 S | | 4/1996 | Miyazawa et al. | 347/86 |
| 5,560,720 A | | 10/1996 | Suzuki et al. | 400/124.1 |
| 5,576,749 A | | 11/1996 | Mochizuki et al. | 347/86 |
| 5,590,510 A | | 1/1997 | Mochizuki et al. | 53/434 |
| 5,603,577 A | | 2/1997 | Suzuki et al. | 400/124.1 |
| 5,607,242 A | | 3/1997 | Suzuki et al. | 400/124.1 |
| 5,615,957 A | | 4/1997 | Suzuki et al. | 400/124.1 |
| 5,622,439 A | | 4/1997 | Suzuki et al. | 400/124.1 |
| D381,039 S | | 7/1997 | Shinada et al. | 347/86 |
| D389,180 S | | 1/1998 | Miyazawa et al. | 347/87 |
| D390,598 S | | 2/1998 | Miyazawa et al. | 347/86 |

(List continued on next page.)

FOREIGN PATENT DOCUMENTS

| | | | |
|---|---|---|---|
| EP | 0 529 879 A1 | 11/1894 | B41J/2/175 |
| EP | 0 635 373 A1 | 10/1899 | B41J/2/175 |
| EP | 0 624 475 A2 | 11/1994 | B41J/2/175 |
| EP | 0 633 138 A2 | 1/1995 | B41J/2/175 |
| EP | 0 647 527 A11 | 4/1995 | B41J/2/175 |
| EP | 0 624 475 A3 | 5/1995 | B41J/2/175 |
| EP | 0 633 138 A3 | 6/1995 | B41J/2/175 |
| EP | 0 624 475 B1 | 3/1999 | B41J/2/175 |

*Primary Examiner*—Juanita Stephens
(74) *Attorney, Agent, or Firm*—Fay, Sharpe, Fagan, Minnich & McKee, LLP

(57) ABSTRACT

An air-impermeable, nonporous seal member is disposed in the outlet passage of an ink cartridge. A housing in the cartridge has a chamber that stores ink therein and communicates with the outlet passage. The seal member is preferably formed of one of a rubber, polyvinyl chloride, thermoplastic rubber, or silicone rubber. The seal member frictionally engages an inner wall of the outlet passage and has a thin membrane that is selectively pierced by an associated needle of the printer.

24 Claims, 1 Drawing Sheet

U.S. PATENT DOCUMENTS

| | | | | | |
|---|---|---|---|---|---|
| 5,790,158 | A | * | 8/1998 | Shinada et al. | 347/86 |
| 5,821,965 | A | | 10/1998 | Oda et al. | 347/86 |
| 5,875,615 | A | | 3/1999 | Ito et al. | 347/86 |
| 5,950,403 | A | | 9/1999 | Yamaguchi et al. | 53/434 |
| 6,045,207 | A | | 4/2000 | Mochizuki et al. | 347/86 |
| 6,048,056 | A | | 4/2000 | Hotomi | 347/86 |
| 6,058,984 | A | | 5/2000 | Sato | 347/86 |
| D427,236 | S | | 6/2000 | Shinada et al. | 347/86 |
| 6,086,193 | A | * | 7/2000 | Shinada et al. | 347/86 |
| 6,123,469 | A | | 9/2000 | Suzuki et al. | 347/84 |
| 6,145,974 | A | | 11/2000 | Shinada et al. | 347/87 |
| 6,170,941 | B1 | | 1/2001 | Hara et al. | 347/86 |
| 6,238,042 | B1 | | 5/2001 | Kobayashi et al. | 347/86 |
| 6,325,499 | B1 | | 12/2001 | Betschon | 347/86 |

* cited by examiner

SEAL MEMBER FOR INK JET CARTRIDGE

CROSS-REFERENCE TO RELATED APPLICATIONS

This application claims priority from provisional application Ser. No. 60/298,039, filed Jun. 13, 2001.

BACKGROUND OF THE INVENTION

This application relates to an ink jet cartridge or cassette as used in an ink jet printer, and more particularly to an apparatus and method for reducing the introduction of air into the system. It will be appreciated, however, that the invention may find application in related environments and applications that encounter these same issues.

It is generally known in the art to form a cartridge housing or body having one or more cavities or chambers that hold a predetermined supply of ink. For example, a single color of ink may be provided in a single chamber cartridge. Alternatively, multiple chambers may be provided, for example, each holding a different color ink stored therein for selective use in a color printer. It is also generally known to provide an ink absorbing member such as a reticulated polyethylene or melamine foam that fits within the chamber (s). In some arrangements, the ink absorbing member fills the substantial entirety of the chamber, while in other instances a portion of the ink supply is free ink and the remainder is stored in the ink absorbing member. In still other instances, all of the ink is stored as free ink in the cartridge. One or more outlet ports communicate with the respective one or more chambers through outlet passages. The outlet passage proceeds through a first or bottom wall of the housing. A supply needle from an associated printer extends through the outlet port and thus conveys ink from the housing to a recording head or printhead.

Print quality can be adversely effected by the introduction of air into the ink chamber or outlet passage. Thus, manufacturers of ink cartridges are careful in the design and assembly, i.e., filling, to limit the potential for air introduction into the system. One area of potential air introduction is through a seal member such as a grommet or septum that normally closes the outlet port. Seal members as used in commercially available cartridges are typically made from a porous material that allows permeation of both air and water. The entry of air through the seal member can dramatically effect performance of the printer, allowing air bubbles to form in the outlet port and creating print voids, or ink starvation problems.

Manufacturers have attempted to resolve the problem by using multiple seal members, e.g., use of a secondary seal over the seal member disposed in the outlet port such as a removable tape or film over the outlet port, or a tape/film that can be pierced by the supply needle associated with the printer. This secondary seal adds additional material, costs, and assembly to the cartridge in order to effect an improved seal at the outlet port.

Thus, a need exists to improve print quality and particularly limit the potential for air entering the cartridge through the outlet port.

SUMMARY OF THE INVENTION

The present invention provides an ink cartridge in which a housing has a chamber formed therein for receiving ink and a first or lower surface containing an outlet passage communicating with the chamber. An air-impermeable, nonporous seal member is received in the outlet passage for preventing air from entering the cartridge through the outlet passage.

The seal member is preferably formed of one of a rubber, polyvinyl chloride, thermoplastic rubber, or silicone rubber.

The seal member includes a thin membrane extending across and substantially perpendicular to a cylindrical portion that frictionally engages an inner wall of the outlet passage.

A primary advantage of the invention resides in the improved print quality that results.

Another advantage of the invention relates to the reduction of air introduced into the printing system.

Still other advantages and benefits of the invention will become apparent to those skilled in the art upon reading and understanding the following detailed description.

BRIEF DESCRIPTION OF THE DRAWINGS

The invention may take form in certain components, structures, and steps, preferred embodiments of which are illustrated in the accompanying drawings.

DETAILED DESCRIPTION OF THE INVENTION

Figure 1:
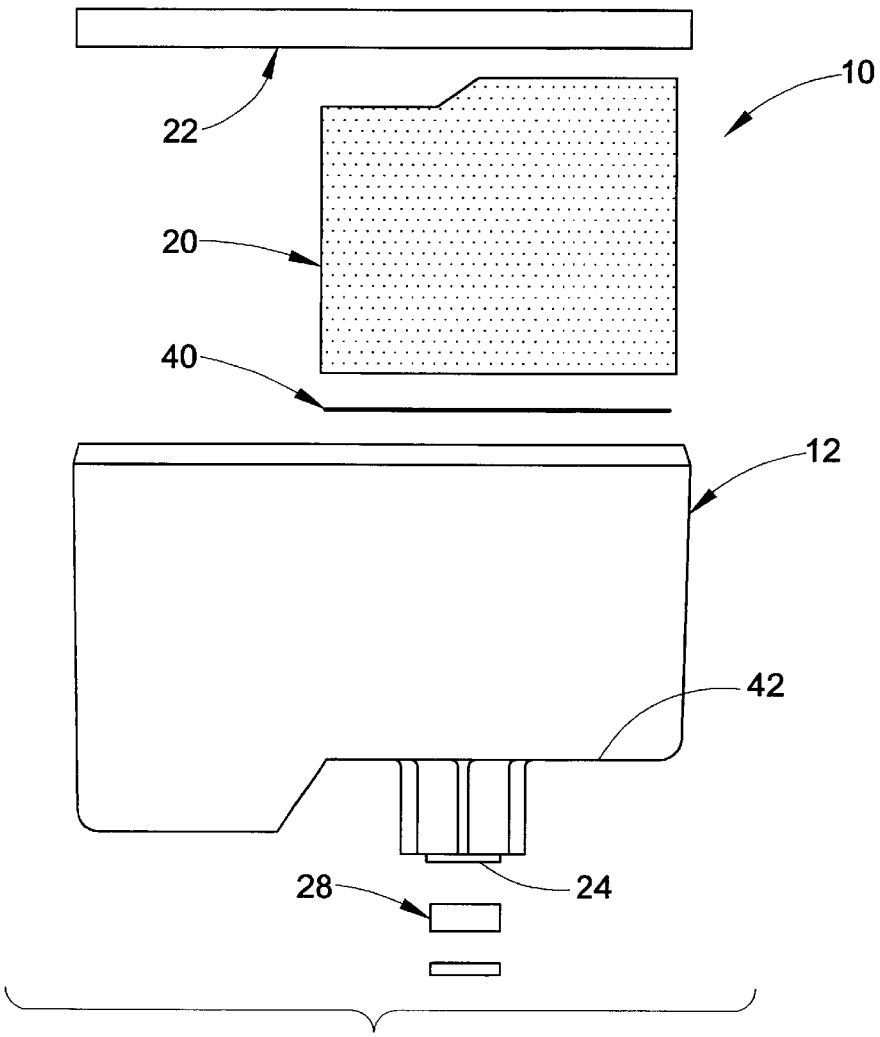
FIG. 1 is an exploded view of the individual components of an ink cartridge.
Figure 2:
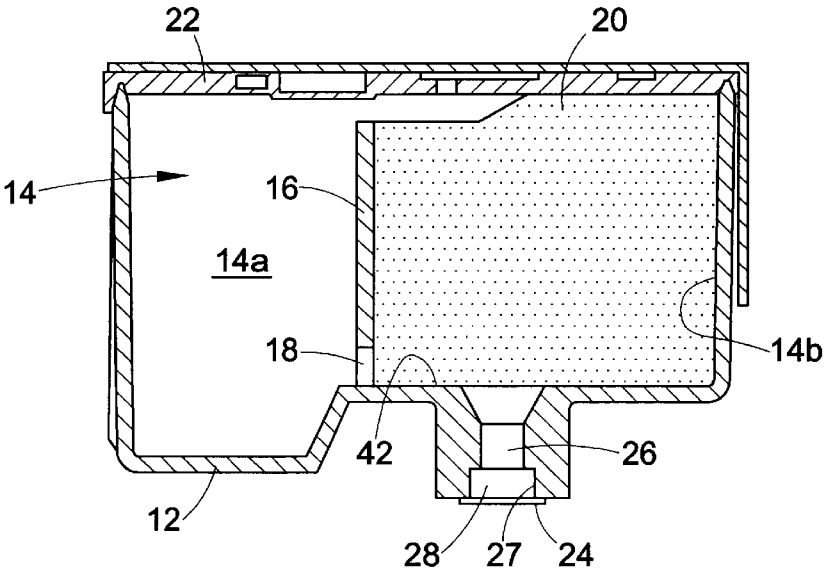
FIG. 2 is a longitudinal cross-sectional view of the ink cartridge of FIG. 1.

As illustrated in FIGS. 1 and 2, an ink jet cassette or cartridge 10 includes a housing 12 having an internal chamber or cavity 14 (FIG. 2). As shown here, the housing interior is divided into two chambers 14*a*, 14*b* by a dividing wall 16. It will be appreciated, however, that the housing may have one chamber, or multiple chambers. For example, the cartridge may be partially free ink/partially foam design, entirely foam, entirely free ink, or the cartridge may be a single color versus multi-color cartridge as noted above. The invention should not however be limited to a single or multi-chamber arrangement. In the partial free ink/partial foam design, a passageway 18 is provided in a base portion of the dividing wall to allow ink to migrate from the free ink side to an ink absorbing member 20. The ink absorbing member is typically a block of porous material or foam such as a reticulated polymer foam or melamine foam, or other conventional ink absorbing member used to store ink within the pores thereof. As shown in FIG. 2, with the partial free ink/partial foam design, the ink absorbing member 20 substantially fills the entire chamber 14*b* on the foam side of the cartridge. In other designs that do not employ free ink, the ink absorbing member will fill substantially the entire cavity or portions of a chamber. Again, the invention should not be so limited to any one of these designs.

A lid or cover 22 is received over a first or upper end of the housing and typically sealingly secured in place. For example, the cover may be ultrasonically welded along a peripheral portion to the cartridge housing to seal the components together. An ink outlet port 24 communicates via an outlet passage 26 with the chamber of the cartridge. The outlet passage includes a counterbore 27 extending inwardly from port 24. In this manner, ink flows from the ink chamber through the outlet passage and ultimately reaches the outlet port 24. The outlet passage receives an air-impermeable, nonporous seal member or grommet 28 that is selectively pierced by a needle from an associated printer (not shown). Once the seal member is pierced, communication is established between the ink in the chamber/outlet passage with the outlet port in a manner generally well known in the art.

Figure 3:
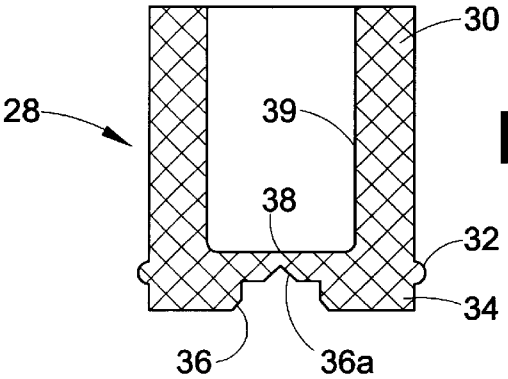
FIG. 3 is an enlarged longitudinal cross-section of the seal grommet according to the present invention.

With continued reference to FIGS. 1 and 2, and additional reference to FIG. 3, the preferred seal member 28 is shown in greater detail. It has a generally cylindrical conformation that is cup-shaped in cross-section. This cylindrical conformation includes a first or upper portion 30 that is dimensioned for frictional engagement with a like-dimensioned counterbored portion 27 of the outlet passage just inwardly of the outlet port. A circumferentially continuous bead 32 is located adjacent a second or lower portion 34 to provide positive engagement with a groove in the outlet passage. Moreover, a recess 36 in the first or lower end extends inwardly toward a thin membrane or web 38 that extends across the central opening 39 in the seal member. A tapering portion 36*a* of the recess acts as a guide to direct the printer needle toward the thin membrane 38 whereby the membrane is selectively pierced by the printer needle at the narrowest strip of the membrane.

Because of the problems noted above with regard to permeation of both air and water, the seal member of the present invention proposes use of an alternative seal member material such as silicone rubber, polyvinyl chloride, or treated thermoplastic rubber. For example, Silopren® LSR (a registered trademark of the General Electric Company) is a two-component liquid silicone rubber that exhibits the high thermal stability and excellent performance in limiting permeation of both air and water that could otherwise tend to form bubbles in the outlet port. This material is commercially available from the General Electric Company under this trade designation. Another alternative is a liquid silicone rubber, under the trade designation LIM® 6061 (a registered trademark of the General Electric Company). This, too, is a high tensile strength rubber.

Disposed between the outlet passage and the housing chamber is a screen 40 which overlays lower surface 42 of the cartridge and the passage. The screen is preferably interposed between the ink absorbing member 20 and the outlet passage.

The application has been described with reference to the preferred embodiment. Obviously, alterations and modifications will occur to others upon a reading and understanding of the specification. It is intended to include all such modifications and alterations insofar as they come within the scope of the appended claims or the equivalents thereof.

Having thus described the invention, we claim:

1. An ink cartridge comprising:

a housing having a chamber formed therein for receiving ink and a first surface containing an outlet passage communicating with the chamber and through which ink is selectively dispensed, said outlet passage having an axis; and an air impermeable, non-porous seal member received in the outlet passage for preventing air from entering the outlet passage, said seal member comprising a wall transverse to said axis, said wall having an axial thickness and including a membrane portion to be pierced by a needle of an associated printer, said membrane portion being axially thinner than said axial thickness.

2. The ink cartridge of claim 1 wherein the seal member is formed of a rubber.

3. The ink cartridge of claim 1 wherein the seal member is formed of a polyvinyl chloride (PVC).

4. The ink cartridge of claim 1 wherein the seal member is formed of a thermoplastic rubber.

5. The ink cartridge of claim 1 wherein the seal member is formed of silicone rubber.

6. The ink cartridge of claim 1 wherein the seal member has a generally cup-shape, in which a cylindrical portion extending axially of said wall frictionally engages an inner wall of the outlet passage.

7. The ink cartridge of claim 6, wherein the wall of said seal member has inner and outer sides and said membrane has an inner side coplanar with the inner side of the seal member wall.

8. The ink cartridge of claim 7, wherein said membrane has an outer side and said wall of said seal member includes a needle guide between the outer side of the seal member wall and the outer side of the membrane.

9. The ink cartridge of claim 8, wherein said needle guide includes a tapered recess converging in the direction from said outer side of the seal member wall toward the outer side of said membrane.

10. The ink cartridge of claim 1 wherein the seal member wall has a substantially disk shape.

11. The ink cartridge of claim 10 wherein the outlet passage includes a counterbore at an outer terminal end that receives the disk-shaped seal member therein.

12. The ink cartridge of claim 11, wherein the seal member includes a cylindrical portion extending from said wall axially inwardly of said counterbore.

13. An ink cartridge for use with an inkjet printer, the cartridge comprising:

a housing having at least one chamber adapted to receive ink therein;

a passage leading to an outlet port in fluid communication with the chamber whereby ink is selectively dispensed from the chamber; and an air impermeable, non-porous seal member disposed in the passage the seal member comprising a wall extending across the outlet port and including an integral membrane dimensioned to be selectively pierced by an associated needle of a printer, said wall having a thickness and said membrane having a thickness less than that of the wall.

14. The ink cartridge of claim 13 wherein the seal member is formed of a rubber material.

15. The ink cartridge of claim 13 wherein the seal member is formed of a silicone rubber.

16. The ink cartridge of claim 13 wherein the seal member is formed of a polyvinyl chloride.

17. The ink cartridge of claim 13 wherein the passage includes a counterbore at the outlet port dimensioned to receive the seal member therein.

18. The ink cartridge of claim 13 wherein the ink chamber includes a wall dividing the chamber into first and second portions, the first portion substantially filled with an ink absorbing member.

19. The ink cartridge of claim 18, wherein the wall includes an opening adapted to allow free ink from the ink chamber second portion to pass therethrough and reach the ink absorbing member.

20. The ink cartridge of claim 13 wherein the seal member includes a circumferentially continuous protrusion dimensioned for receipt in a mating groove in the passage adjacent the outlet port.

21. The ink cartridge of claim 13 wherein the wall of the seal member includes a tapering region for guiding an associated needle of a printer toward the thin membrane.

22. The ink cartridge of claim 13, wherein said seal member includes a cylindrical portion extending from said wall into said passage, said wall having inner and outer sides, and said membrane being adjacent said inner side.

23. The ink cartridge of claim 22, wherein said wall includes a recess extending inwardly from the outer side thereof and including a needle guide portion extending toward said membrane.

24. The ink cartridge of claim 23, wherein said needle guide portion is funnel-shaped and converges in the direction from the outer side of the wall toward the membrane.

* * * * *